US009782650B1

(12) United States Patent
Holcomb

(10) Patent No.: US 9,782,650 B1
(45) Date of Patent: Oct. 10, 2017

(54) ATTACHABLE BASKETBALL TRAINING DEVICE

(71) Applicant: Alex Holcomb, Oviedo, FL (US)

(72) Inventor: Alex Holcomb, Oviedo, FL (US)

( * ) Notice: Subject to any disclaimer, the term of this patent is extended or adjusted under 35 U.S.C. 154(b) by 151 days.

(21) Appl. No.: 14/941,140

(22) Filed: Nov. 13, 2015

(51) Int. Cl.
*A63B 69/00* (2006.01)
*A63B 63/08* (2006.01)

(52) U.S. Cl.
CPC ..... *A63B 69/0071* (2013.01); *A63B 63/08* (2013.01); *A63B 63/083* (2013.01); *A63B 2208/0204* (2013.01); *A63B 2243/0037* (2013.01)

(58) Field of Classification Search
CPC ... A63B 69/0071; A63B 63/083; A63B 63/08; A63B 2243/0037
USPC ..... 473/479, 433, 447, 448, 422, 449, 473/480–484, 472
See application file for complete search history.

(56) References Cited

U.S. PATENT DOCUMENTS 3,160,414 A 12/1964 Gray
7,427,244 B1 9/2008 Patel
7,597,635 B2 10/2009 Davies

*Primary Examiner* — Aarti B Berdichevsky
*Assistant Examiner* — Rayshun Peng
(74) *Attorney, Agent, or Firm* — Stevenson IP, LLC

(57) ABSTRACT

An attachable basketball training device including a substantially semicircular inverted R-shaped clamp having a curved right portion, a curved left portion, a linear middle portion, and a continuous bottom opening. Each of the right portion, the left portion, and the middle portion has an interior lip and an exterior lip. A horizontal slot is medially disposed through the interior lip of the middle portion of the clamp, with a tab slidably engageable within the slot. A plurality of slits is disposed through the interior lip of each of the right portion of the clamp and the left portion of the clamp. Each of a plurality of vertical projections has a looped top section and a linear sword-shaped bottom section. The top section of each of the plurality of vertical projections is disposed through each of the plurality of slits. The clamp is removably attachable to a basketball hoop.

4 Claims, 3 Drawing Sheets

ATTACHABLE BASKETBALL TRAINING DEVICE

BACKGROUND OF THE INVENTION

Various types of training devices for the sport of basketball are known in the prior art. However, what has been needed is an attachable basketball training device including a substantially semicircular inverted R-shaped clamp having a curved right portion, a curved left portion, a linear middle portion, and a continuous bottom opening. Each of the right portion, the left portion, and the middle portion has an interior lip and an exterior lip. What has been further needed is a horizontal slot medially disposed through the interior lip of the middle portion of the clamp, with a tab slidably engageable within the slot. Lastly, what has been needed is a plurality of slits disposed through the interior lip of each of the right portion of the clamp and the left portion of the clamp, with each of a plurality of vertical projections having a looped top section disposed through each of the plurality of slits and a linear sword-shaped bottom section. The clamp is removably attachable to an exterior surface of a rear half of a basketball hoop through the bottom opening of the clamp.

The attachable basketball training device thus assists a basketball player in developing accurate alignment and shooting skills, since the player can align a finger with one of the plurality of vertical supports, which are optionally color-coded, from anywhere on the court. The slidably engageable tab also acts as a visual target for the player while shooting, with the tab being adjustable along a length of the slot depending upon the location of the player on the court.

FIELD OF THE INVENTION

The present invention relates to training devices for the sport of basketball, and more particularly, to an attachable basketball training device.

SUMMARY OF THE INVENTION

The general purpose of the present attachable basketball training device, described subsequently in greater detail, is to provide an attachable basketball training device which has many novel features that result in an attachable basketball training device which is not anticipated, rendered obvious, suggested, or even implied by prior art, either alone or in combination thereof.

To accomplish this, the present attachable basketball training device includes a substantially semicircular inverted R-shaped clamp having a curved right portion, a curved left portion, a linear middle portion, and a continuous bottom opening. Each of the right portion, the left portion, and the middle portion has an interior lip and an exterior lip. Each of the interior lip and the exterior lip has a bottom edge. A length of the exterior lip of the middle portion is substantially one-third of a length of the exterior lip of the right portion and the exterior lip of the left portion. A horizontal slot is medially disposed through the interior lip of the middle portion of the clamp. The clamp is optionally plastic.

The attachable basketball training device further includes a plurality of horizontal slits disposed through the interior lip of each of the right portion of the clamp and the left portion of the clamp proximal the bottom edge. Each of a plurality of vertical projections has a looped top section and a linear downwardly disposed sword-shaped bottom section. The top section of each of the plurality of vertical projections is disposed through each of the plurality of slits. The plurality of slits and the plurality of vertical projections is optionally six, with three slits and corresponding vertical projections on each of the right portion of the clamp and the left portion of the clamp. A tab is slidably engageable within the slot. The tab has an inverted triangulated front surface disposed outside of the slot. The tab is moveable along an entirety of a length of the slot.

A diameter of the clamp substantially conforms to a diameter of a basketball hoop. The clamp is removably attachable to an exterior surface of a rear half of the basketball hoop through the bottom opening of the clamp. The bottom section of each of the plurality of vertical projections is configured to hang substantially parallel to a net under the basketball hoop.

Thus has been broadly outlined the more important features of the present attachable basketball training device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
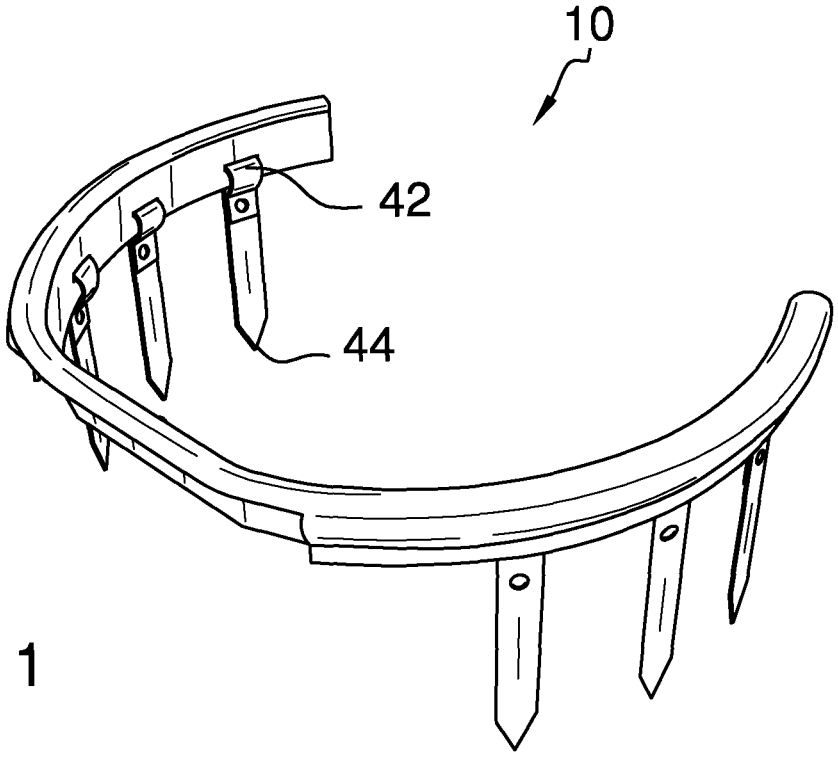
FIG. 1 is a rear isometric view.
Figure 2:
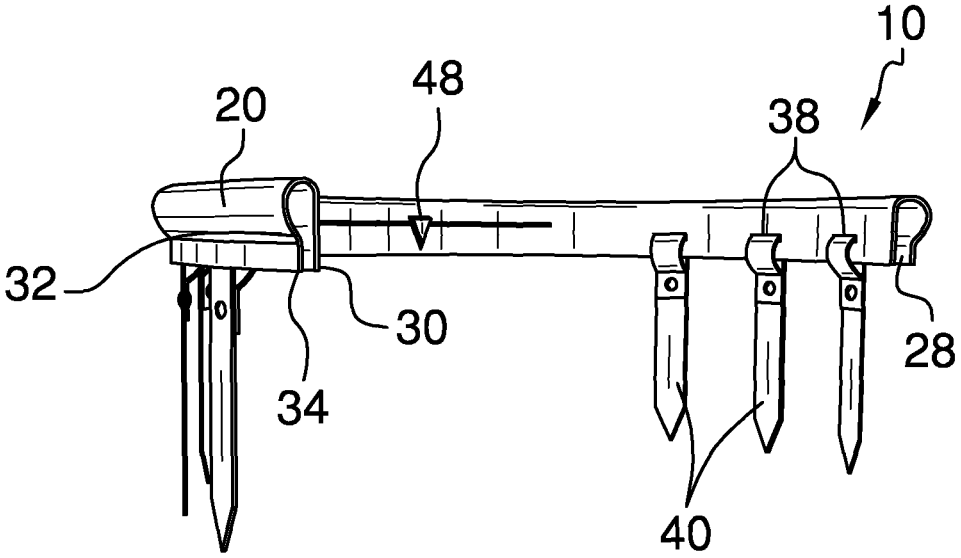
FIG. 2 is a front isometric view.
Figure 3:
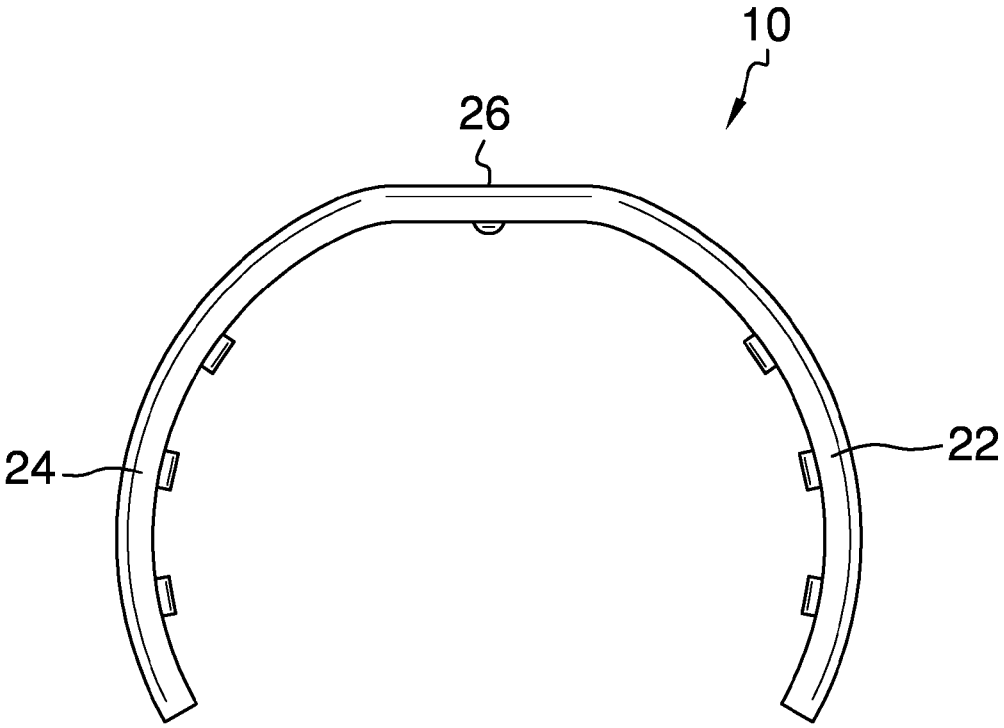
FIG. 3 is a top plan view.
Figure 4:
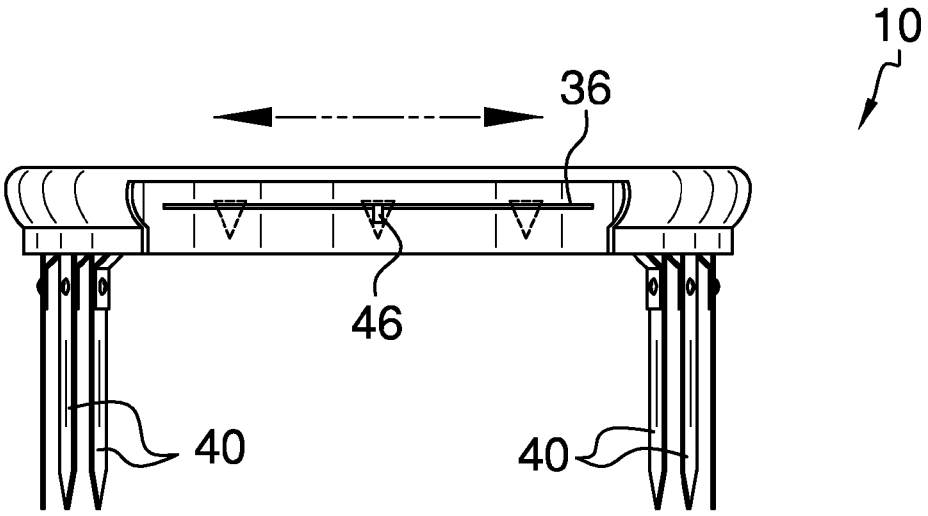
FIG. 4 is a front elevation view.

With reference now to the drawings, and in particular FIGS. 1 through 5 thereof, an example of the instant attachable basketball training device employing the principles and concepts of the present attachable basketball training device and generally designated by the reference number 10 will be described.

Referring to FIGS. 1 through 5 the present attachable basketball training device 10 is illustrated. The attachable basketball training device 10 includes a substantially semicircular inverted R-shaped clamp 20 having a curved right portion 22, a curved left portion 24, a linear middle portion 26, and a continuous bottom opening 28. Each of the right portion 22, the left portion 24, and the middle portion 26 has an interior lip 30 and an exterior lip 32. Each of the interior lip 30 and the exterior lip 32 has a bottom edge 34. A horizontal slot 36 is medially disposed through the interior lip 30 of the middle portion 26 of the clamp 20.

Figure 5:
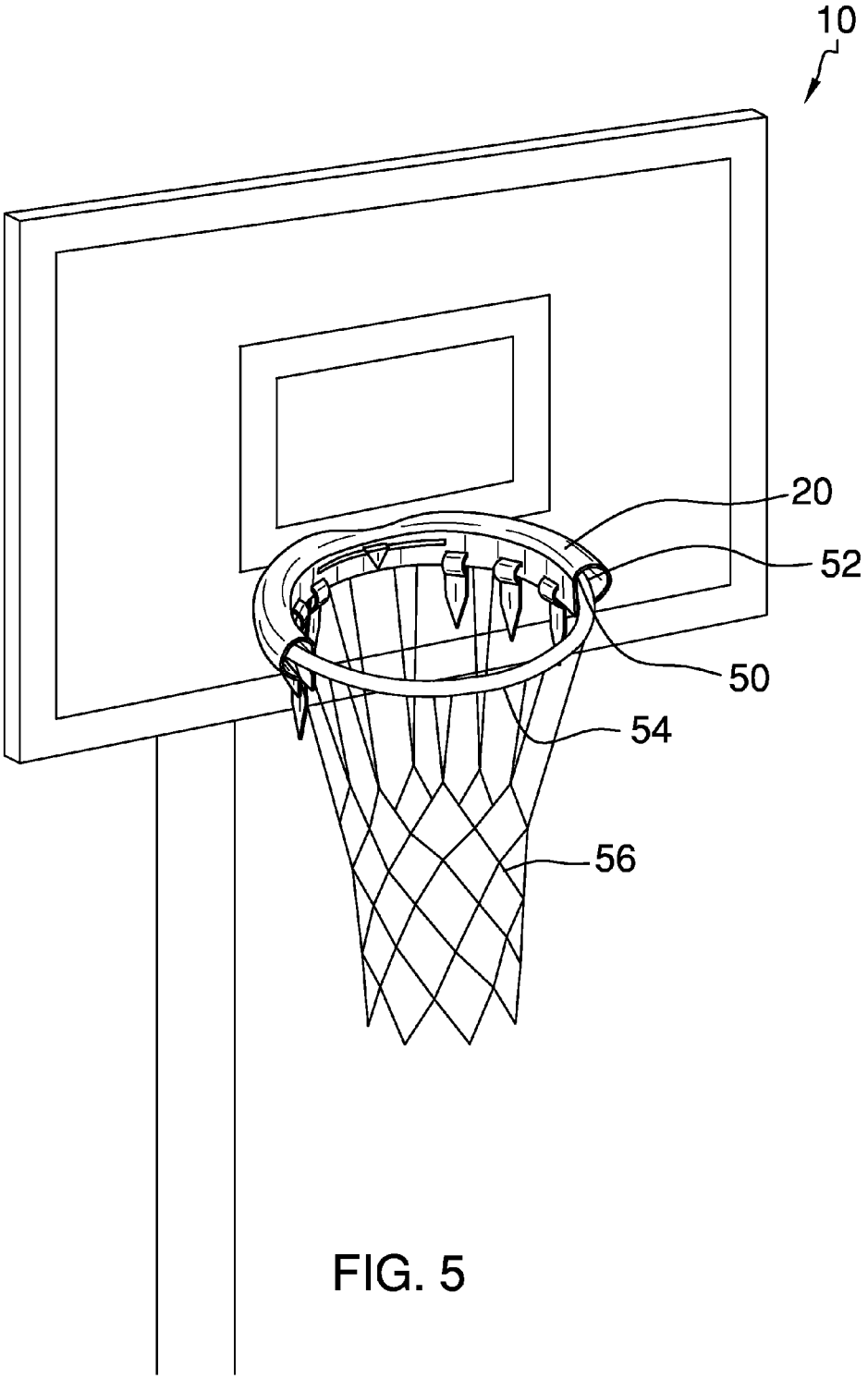
FIG. 5 is an in-use view.

The attachable basketball training device 10 further includes a plurality of horizontal slits 38 disposed through the interior lip 30 of each of the right portion 22 of the clamp 20 and the left portion 24 of the clamp 20 proximal the bottom edge 34. Each of a plurality of vertical projections 40 has a looped top section 42 and a linear downwardly disposed sword-shaped bottom section 44. The top section 42 of each of the plurality of vertical projections 40 is disposed through each of the plurality of slits 38. The plurality of slits 38 and the plurality of vertical projections 40 is optionally six. A tab 46 is slidably engageable within the slot 36. The tab 46 has an inverted triangulated front surface 48 disposed outside of the slot 36. The tab 46 is moveable along an entirety of a length of the slot 36. The clamp 20 is removably attachable to an exterior surface 50 of a rear half 52 of a basketball hoop 54 through the bottom opening 28 of the clamp 20. As best shown in FIG. 5, the bottom section 44 of each of the plurality of vertical projections 40 is configured to hang substantially parallel to a net 56 under the basketball hoop 54.

What is claimed is:

1. An attachable basketball training device comprising:

a substantially semicircular inverted R-shaped clamp having a curved right portion, a curved left portion, a linear middle portion, and a continuous bottom opening, each of the right portion, the left portion, and the middle portion having an interior lip and an exterior lip, each of the interior lip and the exterior lip having a bottom edge, wherein a length of the middle portion exterior lip is substantially one-third of a length of the right portion exterior lip and the left portion exterior lip;

a horizontal slot medially disposed through the interior lip of the clamp middle portion;

a plurality of horizontal slits disposed through the interior lip of each of the clamp right portion and the clamp left portion proximal the bottom edge;

a plurality of vertical projections, each of the plurality of vertical projections having a looped top section and a linear downwardly disposed sword-shaped bottom section, wherein the top section of each of the plurality of vertical projections is disposed through each of the plurality of slits; and a tab slidably engageable within the slot, the tab having an inverted triangulated front surface disposed outside of the slot, wherein the tab is moveable along an entirety of a length of the slot;

wherein a diameter of the clamp substantially conforms to a diameter of a basketball hoop;

wherein the clamp is removably attachable to an exterior surface of a rear half of the basketball hoop through the clamp bottom opening;

wherein the bottom section of each of the plurality of vertical projections is configured to hang substantially parallel to a net under the basketball hoop.

2. The attachable basketball training device of claim 1 wherein the plurality of slits is six, and the plurality of vertical projections is six.

3. The attachable basketball training device of claim 1 wherein the clamp is plastic.

4. An attachable basketball training device comprising:

a substantially semicircular inverted R-shaped clamp having a curved right portion, a curved left portion, a linear middle portion, and a continuous bottom opening, each of the right portion, the left portion, and the middle portion having an interior lip and an exterior lip, each of the interior lip and the exterior lip having a bottom edge, wherein a length of the middle portion exterior lip is substantially one-third of a length of the right portion exterior lip and the left portion exterior lip;

wherein the clamp is plastic;

a horizontal slot medially disposed through the interior lip of the clamp middle portion;

a plurality of horizontal slits disposed through the interior lip of each of the clamp right portion and the clamp left portion proximal the bottom edge;

wherein the plurality of slits is six;

a plurality of vertical projections, each of the plurality of vertical projections having a looped top section and a linear downwardly disposed sword-shaped bottom section, wherein the top section of each of the plurality of vertical projections is disposed through each of the plurality of slits;

wherein the plurality of vertical projections is six; and a tab slidably engageable within the slot, the tab having an inverted triangulated front surface disposed outside of the slot, wherein the tab is moveable along an entirety of a length of the slot;

wherein a diameter of the clamp substantially conforms to a diameter of a basketball hoop;

wherein the clamp is removably attachable to an exterior surface of a rear half of the basketball hoop through the clamp bottom opening;

wherein the bottom section of each of the plurality of vertical projections is configured to hang substantially parallel to a net under the basketball hoop.

* * * * *